US007910849B2

(12) United States Patent
Hibshman et al.

(10) Patent No.: US 7,910,849 B2
(45) Date of Patent: Mar. 22, 2011

(54) BUTTON MOUNT FOR A LIGHTING CONTROL

(75) Inventors: Thomas E. Hibshman, Allentown, PA (US); Adam M. Mack, Bethlehem, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 1546 days.

(21) Appl. No.: 11/260,647

(22) Filed: Oct. 27, 2005

(65) Prior Publication Data

US 2007/0096903 A1 May 3, 2007

(51) Int. Cl.
*H01H 13/70* (2006.01)

(52) U.S. Cl. ..... 200/344; 200/553

(58) Field of Classification Search ..... 200/344, 200/345, 339, 553

See application file for complete search history.

(56) References Cited

U.S. PATENT DOCUMENTS

| | | | | |
|---|---|---|---|---|
| 4,638,151 | A * | 1/1987 | Suwa | 235/145 R |
| 4,737,609 | A | 4/1988 | Yuhasz et al. | |
| 4,919,403 | A * | 4/1990 | Bartholomew | 267/165 |
| 5,207,317 | A | 5/1993 | Bryde et al. | |
| 5,637,930 | A | 6/1997 | Rowen et al. | |
| 5,815,570 | A * | 9/1998 | Hannon et al. | 379/433.09 |
| 6,005,308 | A | 12/1999 | Bryde et al. | |
| 6,846,999 | B2 * | 1/2005 | Kawakami et al. | 200/341 |

FOREIGN PATENT DOCUMENTS

| | | |
|---|---|---|
| DE | 10 2004 006939 | 7/2005 |
| EP | 0 634 764 | 1/1995 |
| WO | WO 2004/100197 | 11/2004 |

OTHER PUBLICATIONS

Lutron Electronics Co., Inc., "Description of Button Assembly for NT-Style Two-Button Wallstations" (units described available to the public in 2000).

* cited by examiner

*Primary Examiner* — Renee S Luebke
*Assistant Examiner* — Lisa Klaus
(74) *Attorney, Agent, or Firm* — Drinker Biddle & Reath LLP

(57) ABSTRACT

A mounting system for a button includes first and second spring elements located adjacent opposite ends of the button. Each of the spring elements includes a serpentine portion capable of multiple degrees of freedom of movement providing varying actuating motions for the button. The spring elements may be defined by a plate also having a center portion secured to the button and opposite end portions secured to a base. According to one embodiment, the button is made from a thermoplastic material and the plate is metal.

24 Claims, 11 Drawing Sheets

BUTTON MOUNT FOR A LIGHTING CONTROL

FIELD OF THE INVENTION

The present invention relates to lighting controls and more particularly to a button mounting system for a lighting control.

BACKGROUND OF THE INVENTION

Known lighting controls include an on/off mechanism having a button that actuates a momentary tactile switch when the button is pressed by a user. The on/off button of the Vareo® lighting control by Lutron Electronics Co., Inc. of Coopersburg, Pa. is located next to a slide actuator of a dimmer mechanism. Referring to FIGS. 1 and 2, the prior on/off button 10 of the Vareo® lighting control is shown separately from the lighting control along with flexible button supports 12 located at opposite ends of the button 10. The button supports 12 are integrally molded with the button 10 from a thermoplastic material such as polycarbonate.

Each of the button supports 12 includes a tab 14 connected to one of the ends of button 10 and a pair of elongated legs 16 extending from opposite sides of the tab 14. A pad 18 projects downwardly (with respect to the view of FIG. 1) from each of the legs 16 for contact with an underlying support surface of the lighting control. Referring to FIG. 2, the pads 18 on the left extend further from the associated legs 16 than those on the right to provide for contact with different support surfaces (e.g., surfaces of a yoke and an adapter).

Referring to the rear perspective view of FIG. 2, a pair of retainer prongs 20 extend from a rear surface of the button 10 for snap attachment with the lighting control to limit unintended removal of the button 10. Posts 22 extend from the rear surface of button 10 for contact with a pivoting hinge bar (not shown) of the lighting control. The hinge bar of the lighting control is adapted to contact the switch of the on/off mechanism to transfer actuating motions of the button 10 to the switch.

Each pair of legs 16 is adapted to flex in response to load applied to the button 10 to provide for a variety of button motions. Contact near the center of the button 10 results in substantially equal flexing of all of the legs 16 and uniform deflection of the button 10. Contact adjacent one of the ends of the button 10 flexes the legs 16 adjacent that end causing the end to deflect while deflection of the opposite end of button 10 is minimal. Contact adjacent one of the opposite sides of the button 10 results in deflection of that side of the button 10 with respect to the opposite side.

The use of polycarbonate provides for integral molding of the button 10, button supports 12, retainer prongs 20 and posts 22 from the same material. In addition to providing for integral molding, polycarbonate provides hardness characteristics desired for actuator buttons. The integral construction of the button supports 12 from the same material as the button 10, although facilitating fabrication, results in less than ideal operating conditions for the flexing button supports 12. As described above, the legs 16 of the button supports 12 contact the yoke of the lighting control. Heat is transferred to the legs 16 of the button support 12 from the yoke during operation of the lighting control. Such heating of the polycarbonate and repeated flexing of the legs 16 can lead to fatigue failures at the junctions between the legs 16 and the tabs 14.

SUMMARY OF THE INVENTION

According to one aspect, the present invention provides a system for mounting a button having opposite ends. The mounting system comprises first and second spring elements each coupled to the button and located adjacent one of the opposite ends of the button. Each of the spring elements has a serpentine portion. The mounting system may further comprise a base adapted to be supported by a surface. Each of the spring elements is coupled to the base such that the spring elements are supported at a distance from the surface.

According to another aspect of the invention, an assembly for a control unit comprises a button having opposite ends, and first and second spring elements each coupled to the button and located adjacent one of the opposite ends of the button. Each of the spring elements includes a serpentine portion adapted for multiple degrees of freedom to provide varying actuating motions of the button.

Further the switch assembly comprises a switch and a hinge bar. The hinge bar is disposed between the button and the switch and is supported for pivot about an axis. The hinge bar is arranged to actuate the switch in a uniform actuation motion in response to any one of the actuating motions of the button.

According to one aspect of the invention, an assembly for a control unit having a yoke is provided. The assembly comprises a button defining opposite ends, and a spring plate comprising a metal secured to the button and supporting the button at a distance from a front surface of the yoke. The spring plate includes first and second spring elements each located adjacent one of the opposite ends of the button and adapted to provide multiple degrees of freedom of movement for the button.

According to yet another aspect of the invention, an actuator assembly comprises a button having opposite ends, and first and second spring elements coupled to the button and located adjacent the opposite ends of the button. Each of the spring elements includes first and second legs extending substantially parallel to each other in side-by-side fashion. The legs of each of the spring elements are connected to each other at an end of the legs and are substantially co-planar with each other when the spring element is in an unloaded neutral condition.

DESCRIPTION OF THE INVENTION

Figure 2:
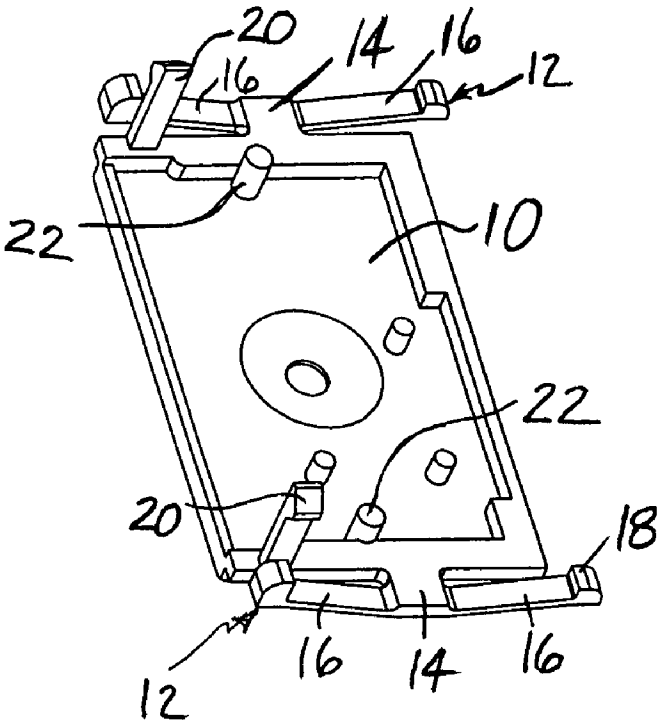
FIG. 2 (Prior Art)
FIG. 2 is a rear perspective view of the prior art button of FIG. 1.
Figure 1:
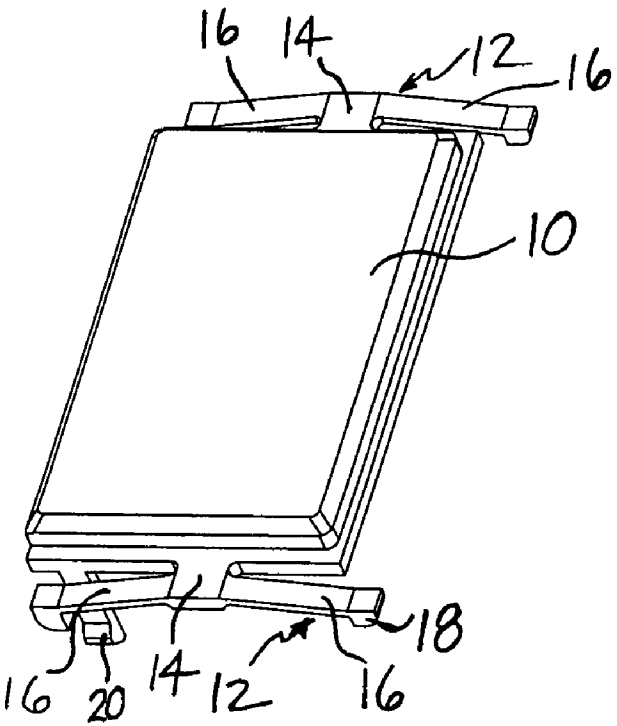
FIG. 1 (Prior Art)
FIG. 1 is a front perspective view of a prior art button for a lighting control.
Figure 3:
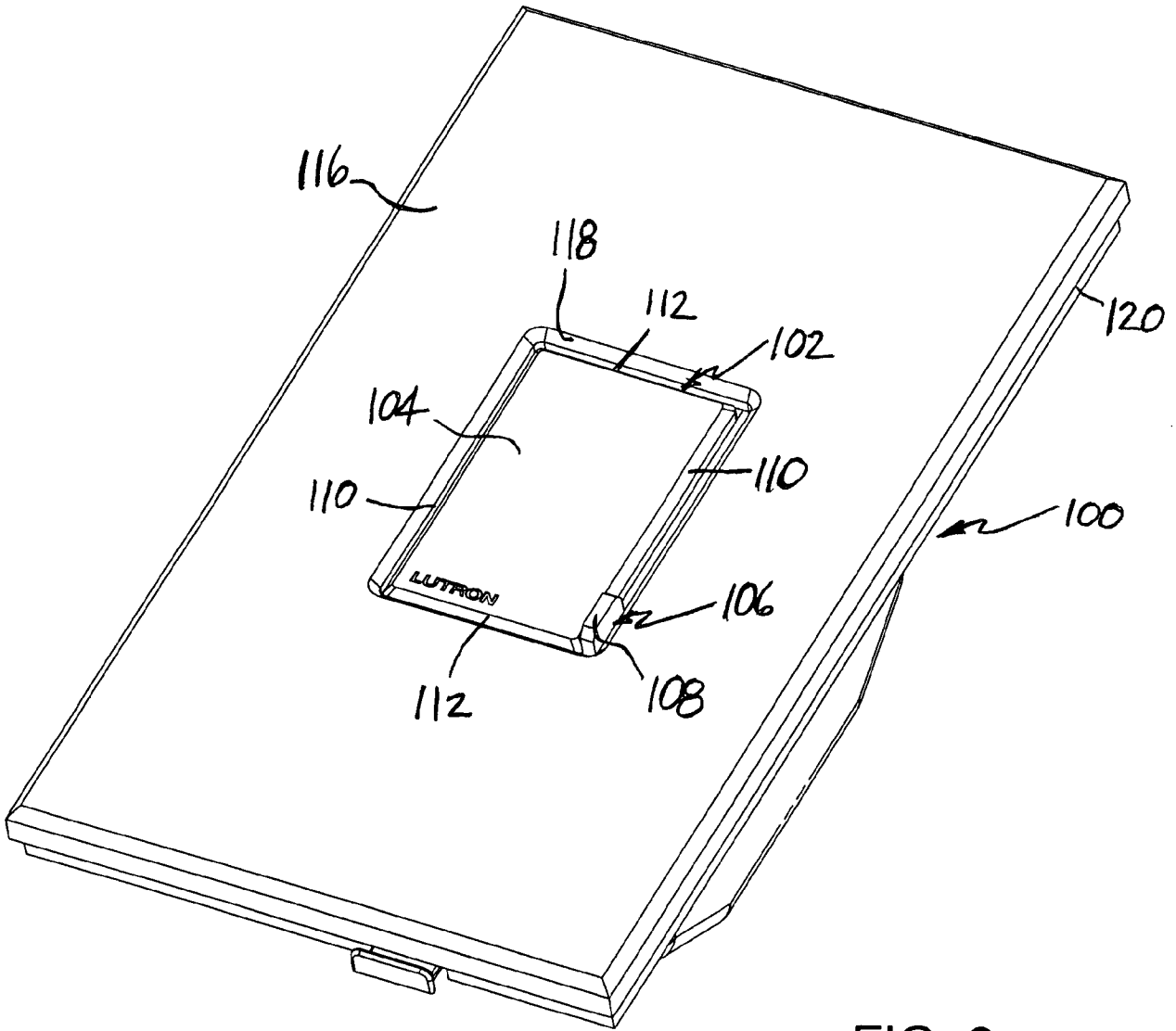
FIG. 3 is a perspective view of a lighting control according to the invention including an on/off mechanism having a button.
Figure 4:
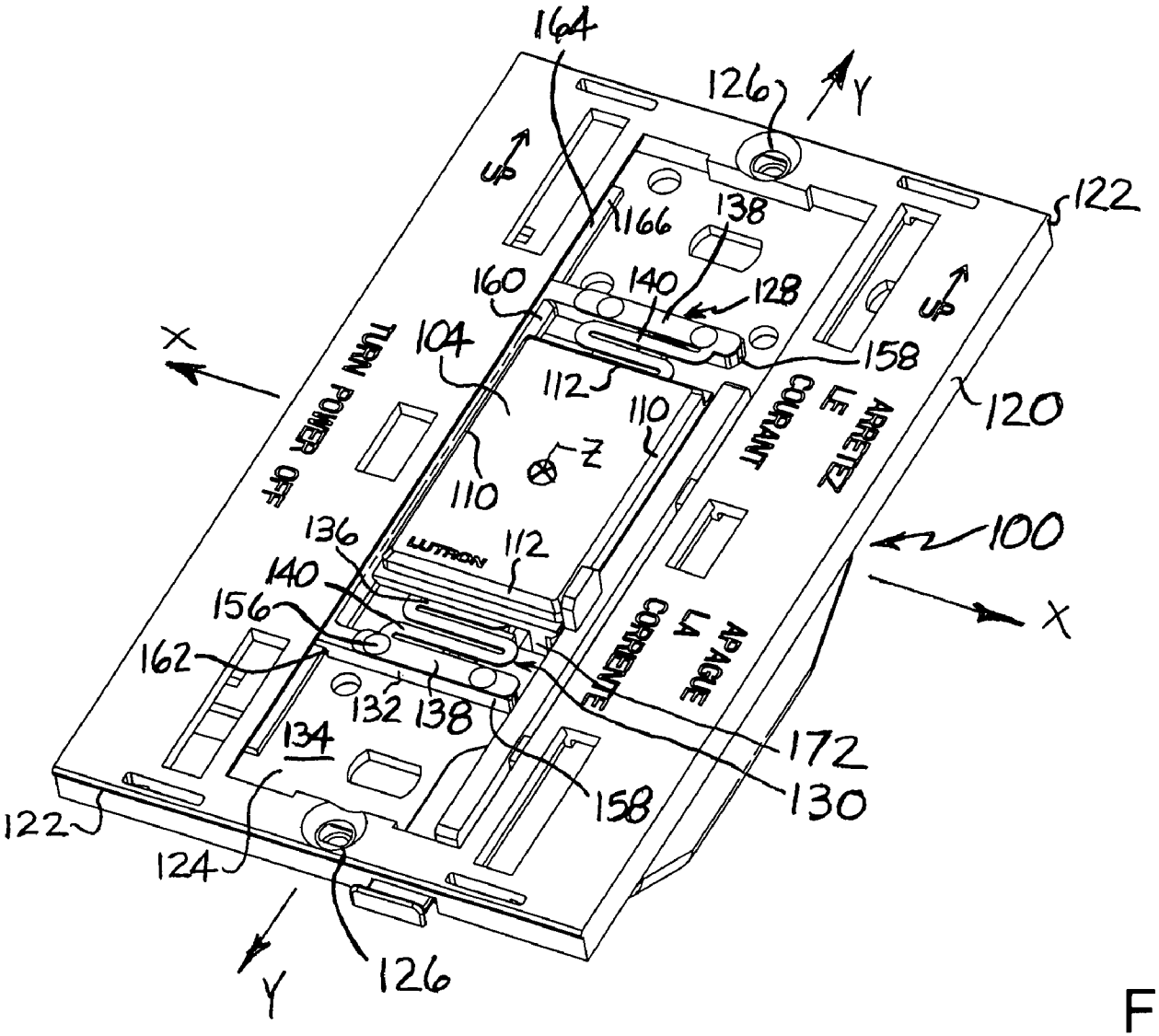
FIG. 4 is a perspective view of the lighting control of FIG. 1 with a faceplate of the lighting control removed to show a mount system for supporting the button of the on/off mechanism.

Referring to the drawings, where like numerals identify like elements, there is shown in FIGS. 3 and 4 a lighting control 100 according to an exemplary embodiment of the invention. The lighting control 100 includes an on/off mechanism 102 having a button 104 and a dimmer mechanism 106 having a slide actuator 108 located next to the button 104. The button 104 is generally rectangular including opposite sides 110 defining a length (along the Y-axis) and opposite ends 112 defining a width (along the X-axis). As described below in greater detail, the lighting control 100 includes a button mounting system that provides multiple degrees of freedom of movement for the button 104. This arrangement provides for varying motions of the button 104 depending on the portion of the button 104 contacted by a user to actuate the on/off mechanism 102. The differing motions of the button 104, however, are transferred to an underlying hinge bar 114 (FIG. 9) to provide for a uniform actuating motion and a consistent actuation of the on/off mechanism 102, as described below. As also described below, the present invention provides a construction that facilitates material selections for optimal fabrication and operation of the on/off mechanism 102. Although the on/off mechanism of the present invention is depicted as part of lighting control 100 also having dimmer mechanism 106, it should be understood that a dimmer mechanism is not required. It should also be understood that the on/off mechanism of the invention is not limited to controls for controlling light and has application to controls for controlling other loads such as a fan for example.

The lighting control 100 includes a faceplate 116 having a rectangular aperture 118 in which the button 104 and slide actuator 108 of the on/off and dimmer mechanisms 102, 106, respectively, are presented to a user. Referring to FIG. 4, the lighting control 100 is shown with the faceplate 116 removed. The lighting control 100 includes a faceplate support member 120. Preferably, the faceplate support member 120 is secured to an underlying yoke 124 of the lighting control 100 by fasteners (not shown) at locations 126. The faceplate 116 and faceplate support member 120 are adapted to provide for snap attachment of the faceplate 116 to the faceplate support member 120. Preferably, the faceplate support member 120 defines peripheral lips 122 engaging corresponding notches defined by the faceplate 116. Alternative snap attachment means could be used such as projecting elements on a rear surface of the faceplate 116 received by openings defined by the faceplate support member 120. This type of faceplate, sometimes referred to as a "screwless" faceplate, having an underlying support member to which the faceplate is releasably attached, is well known and, therefore, no further description is necessary. An example of such a faceplate is disclosed in U.S. Pat. No. 4,835,343, the entirety of which is hereby incorporated by reference.

The button 104 of on/off mechanism 102 is part of an assembly 128 also including a mount system for the button 104. The assembly 128, which is shown separately in FIGS. 5-8, includes a spring plate 130 secured to button 104 to move with button 104 during actuation of the on/off mechanism as described below. The assembly 128 also includes a support base 132 located between the spring plate 130 and the yoke 124. As shown in FIG. 4, the support base 132 supports the spring plate 130 at a distance from the yoke 124. This arrangement provides spacing between a front surface 134 of yoke 124 and spring plate 130 to limit contact that would otherwise occur between opposite end portions of the spring plate 130 and the yoke 124.

Referring to FIGS. 5 through 8, the spring plate 130 includes a rectangular center portion 136 secured to the button 104, end portions 138 secured to the support base 132 and defining opposite ends of the spring plate 130, and serpentine spring elements 140 located between the center portion 136 and each of the end portions 138.

Figure 6:
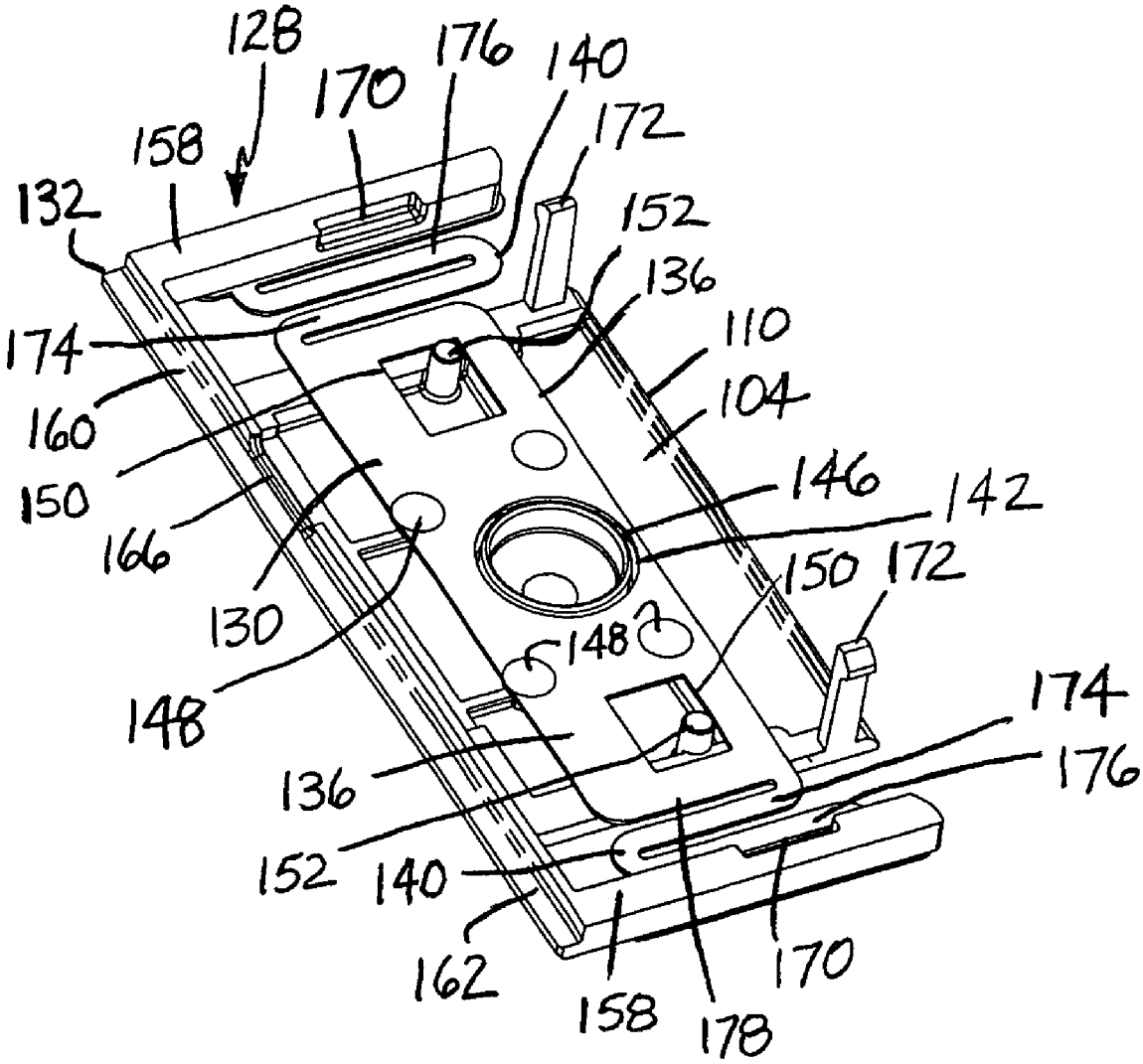
FIG. 6 is a rear perspective view of the button and mount system of FIG. 5.
Figure 7:
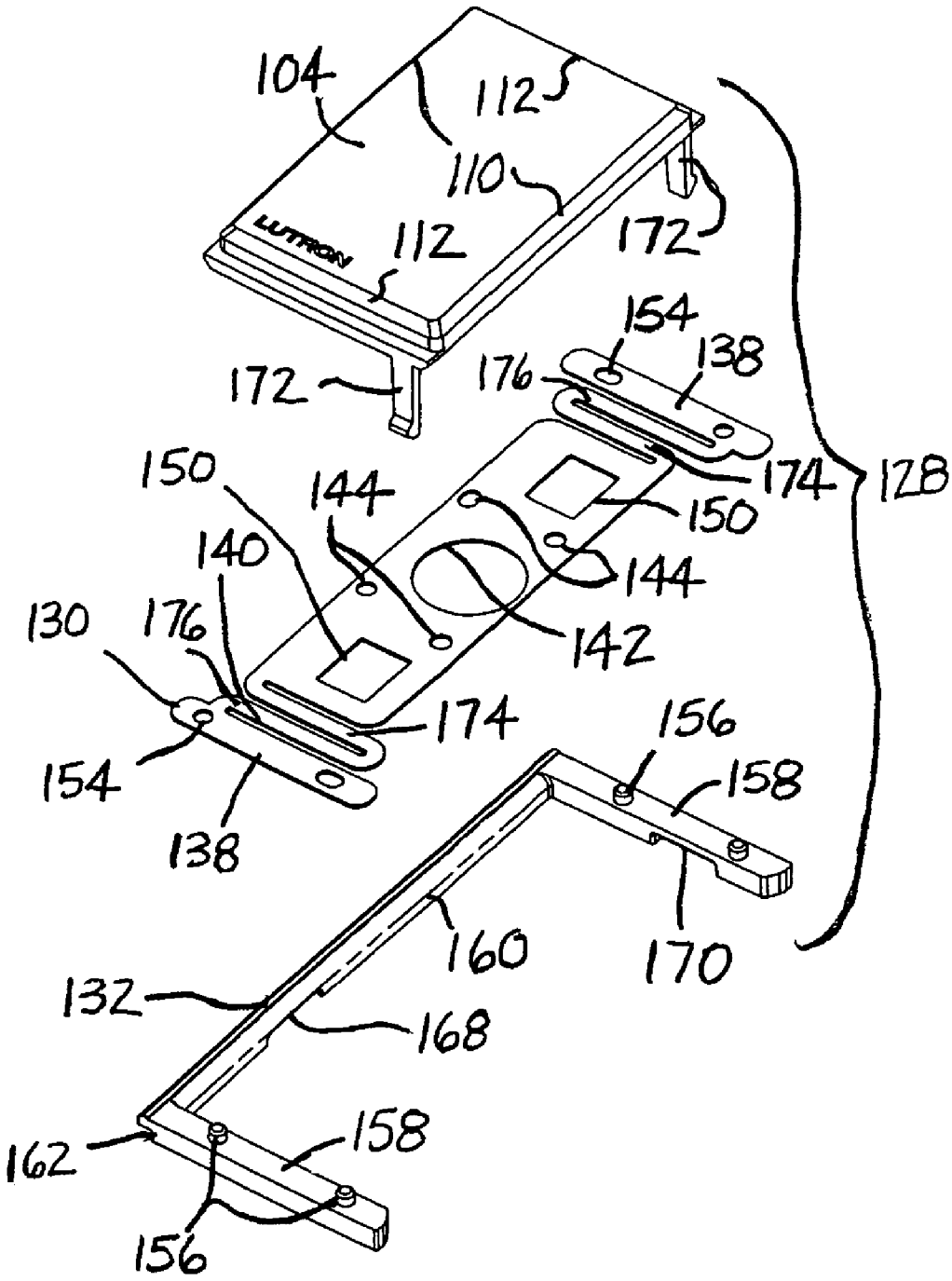
FIG. 7 is a front exploded perspective view of the button and mount system of FIG. 5.
Figure 8:
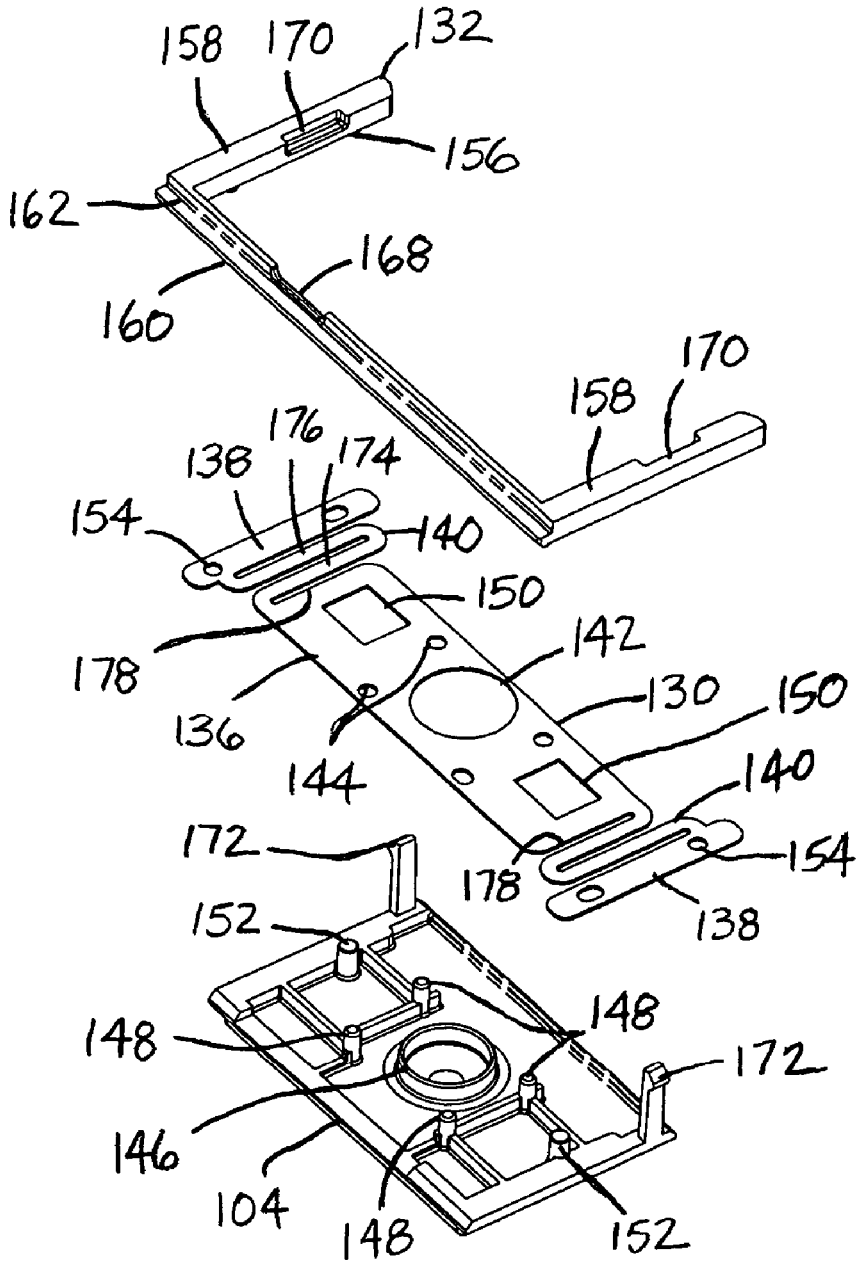
FIG. 8 is a rear exploded perspective view of the button and mount system of FIG. 5.

Referring to FIGS. 6-8, the center portion 136 of spring plate 130 includes a relatively large circular opening 142 and a plurality of relatively small circular openings 144. The opening 142 is adapted for receipt of a cylindrical projection 146 on a rear surface of button 104 located approximately midway between opposite ends of the button 104. The cylindrical projection 146 is located on the rear surface of button 104 at a thin-wall portion of the button 104. The cylindrical projection 146 is adapted for receipt of illumination from a lamp (e.g., a neon bulb or a light-emitting diode) such that light from the lamp is visible through the thin-walled portion of the button 104 to a user of the lighting control 100. The openings 144 are arranged for receipt of cylindrical posts 148 on the rear surface of button 104. As shown in FIG. 6, the posts 148 of button 104 are preferably flattened (e.g., by heat and compression) following their receipt within the openings 144 of spring plate 130. The flattening of the posts 148 widens the posts 148 in a rivet-like fashion to secure the button 104 to the spring plate 130. The center portion 136 of spring plate 130 also includes a pair of square openings 150 arranged to accommodate posts 152 on the rear surface of button 104 that are located adjacent the opposite ends of the button 104. As described below, the posts 152 of button 104 provide for contact between the button 104 and the underlying hinge bar 114 of the on/off mechanism 102.

As shown in FIG. 6, the rectangular center portion 136 of spring plate 130 is elongated to provide a length for the center portion 136 that is approximately equal to a length of the button 104 between ends 112 of the button 104. This arrangement locates the serpentine spring elements 140 adjacent the ends 112 of the button 104 as shown. The center portion 136 of spring plate 130 has a width, as shown, that is sufficient to provide sufficient space for the openings 142, 144, 150. The precise dimensions of the center portion 136 of spring plate 130 are not critical, however, and could vary from those depicted.

Figure 5:
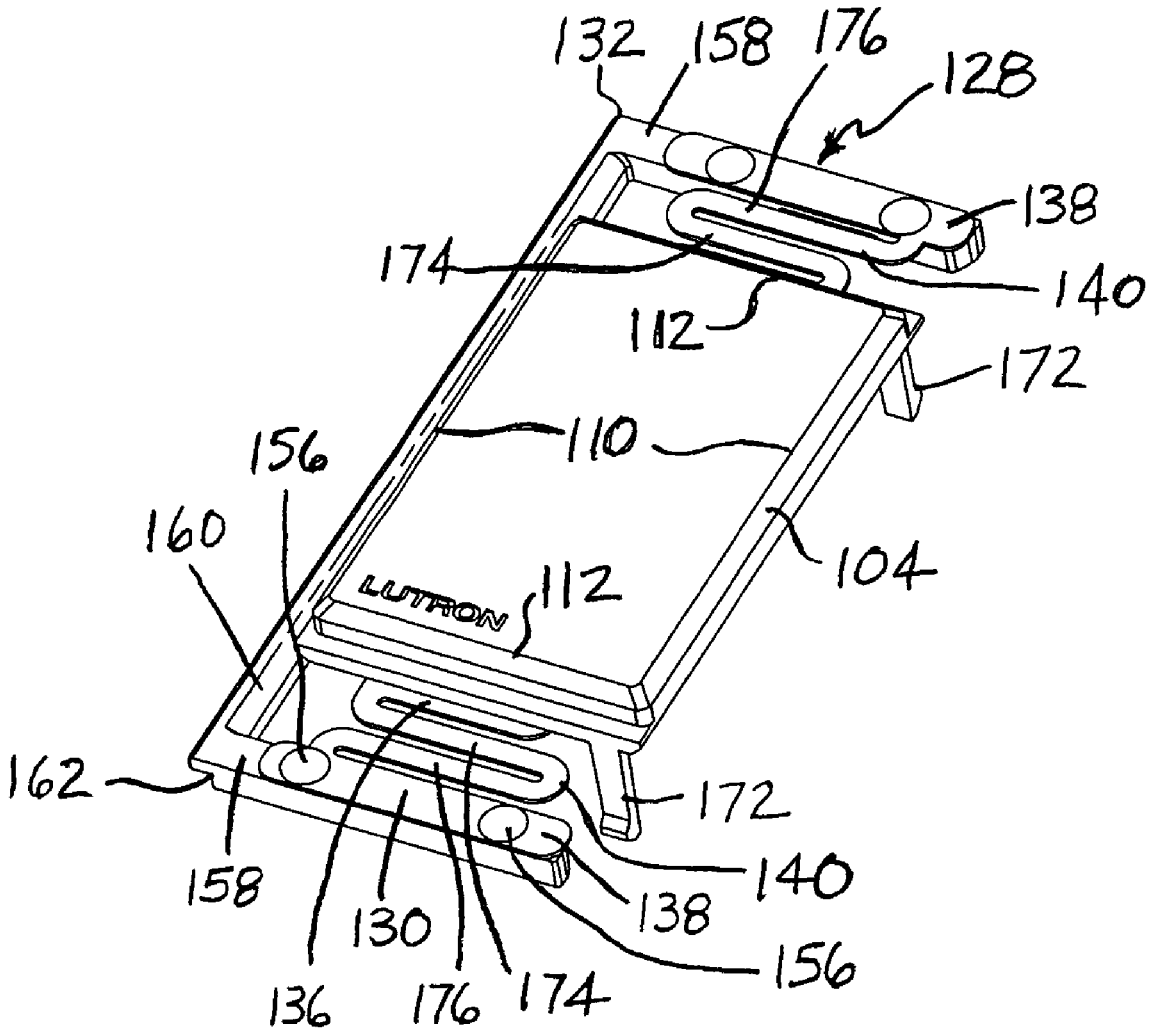
FIG. 5 is a front perspective view of the button and mount system of FIG. 2, shown removed from the lighting control.

Referring to FIGS. 5 and 7, each of the end portions 138 of spring plate 130 includes a pair of circular openings 154 arranged for receipt of cylindrical posts 156 of support base 132. Similar to the posts 148 of button 104, the posts 156 of support base 132 are preferably flattened following receipt of the posts 156 by the openings 154 thereby widening the posts 156 in a rivet-like fashion to secure the spring plate 130 to the support base 132.

The support base 132 includes a pair of pedestal portions 158 arranged at opposite ends of the support base 132 in substantially parallel fashion for supporting the end portions 138 of spring plate 130 at a distance from an upper surface 134 of yoke 124, as shown in FIG. 4. The support base 132 also includes an elongated side bar 160 extending between ends of the pedestal portions 158 such that the support base 132 is generally C-shaped. The support base 132 includes a notch recess 162 formed in a lower surface that extends along the length of the side bar 160. The notch recess 162 in the lower surface of the support base 132 is arranged to receive a lower wall 166 of a retainer channel 164 defined by the faceplate support member 120. Arranged in this manner, a portion of the support base 132 will be captured within the retainer channel 164. The depicted support base 132 also includes notches 168, 170 in lower surfaces of the side bar 160 and pedestal portions 158, respectively, to accommodate underlying elements (not shown) of the lighting control 100 projecting from the upper surface of the yoke 124.

As shown in FIGS. 5-8, the button 104 includes a pair of retainer prongs 172 located at one side of the button 104 opposite the side bar 160 of support base 132. The retainer prongs 172 of button 104 are adapted for snap-type receipt within an interior of the lighting control 100. As described above, the spring plate 130 is secured to the support base 132 and the button 104 is secured to the spring plate 130. As should therefore be understood by those skilled in the art, the capture of the support base 132 within the retainer channel 164 of faceplate support member 120 and the snap receipt of the retainer prongs 172 of button 104 within the interior of lighting control 100, serves to limit unintended removal of the assembly 128 from the lighting control 100. The retainer prongs 172, however, are adapted to permit relative movement between the button 104 and fixed portions of the lighting control 100 desired for actuation of the on/off mechanism 102.

Each of the serpentine spring elements 140 of the spring plate 130 includes first and second legs 174, 176 extending substantially parallel to each other in a close side-by-side fashion. The legs 174, 176 are connected to each other at one end of the legs 174, 176. The legs 174, 176 are also connected to the center portion 136 of the spring plate 130 and to one of the end portions 138, respectively, at an opposite end of the legs 174, 176. The legs 174, 176 of each serpentine spring element 140 are elongated to extend substantially parallel to the end portions 138 of spring plate 130 and substantially parallel to ends 178 of the center portion 136. Arranged in this manner, the serpentine spring elements 140 are located within relatively narrow spaces between the ends 112 of button 104 and the pedestal portions 158 of support base 132. Also, the legs 174, 176 of each serpentine spring element 140 are substantially co-planar with each other when the spring plate 130 is in a neutral condition associated with an unloaded state for button 104 (i.e., in the absence of a force applied to the button by a user of the lighting control 100) because they are part of a plate. Therefore, the spring elements 140 also desirably occupy only a limited space in a transverse direction with respect to button 104 (i.e., along the Z-axis in FIG. 4).

The above-described construction of the serpentine spring elements 140 allows for deflection (along the Z-axis in FIG. 4) of the center portion 136 of spring plate 130, and button 104 secured thereto, with respect to the end portions 138 of spring plate 130 secured to support base 132. Such Z-axis deflection of the center portion 136 of spring plate 130 would occur, for example, when the button 104 is contacted by a user in a central location on button 104.

The construction of the serpentine spring elements 140 also provides for rotation (about the Y-axis in FIG. 4) of the center portion 136 of spring plate 130, and button 104 secured thereto, with respect to the end portions 138 of spring plate 130 secured to support base 132. Such rotation (i.e., twisting motion) of the center portion 136 of spring plate 130 would occur, for example, when the button 104 is contacted by a user adjacent one of the sides 110 of button 104. As shown, the serpentine spring elements 140 are preferably reversed with respect to each other such that the legs 174 are connected to the center portion 136 of spring plate 130 adjacent opposite sides of the center portion 136. The reversed arrangement of the serpentine spring elements 140 in this manner facilitates a uniform torsional reaction of the spring plate 130 to a Y-axis rotation of button 104 regardless of the direction of motion (i.e., regardless which side 110 of button 104 is contacted).

Figure 9:
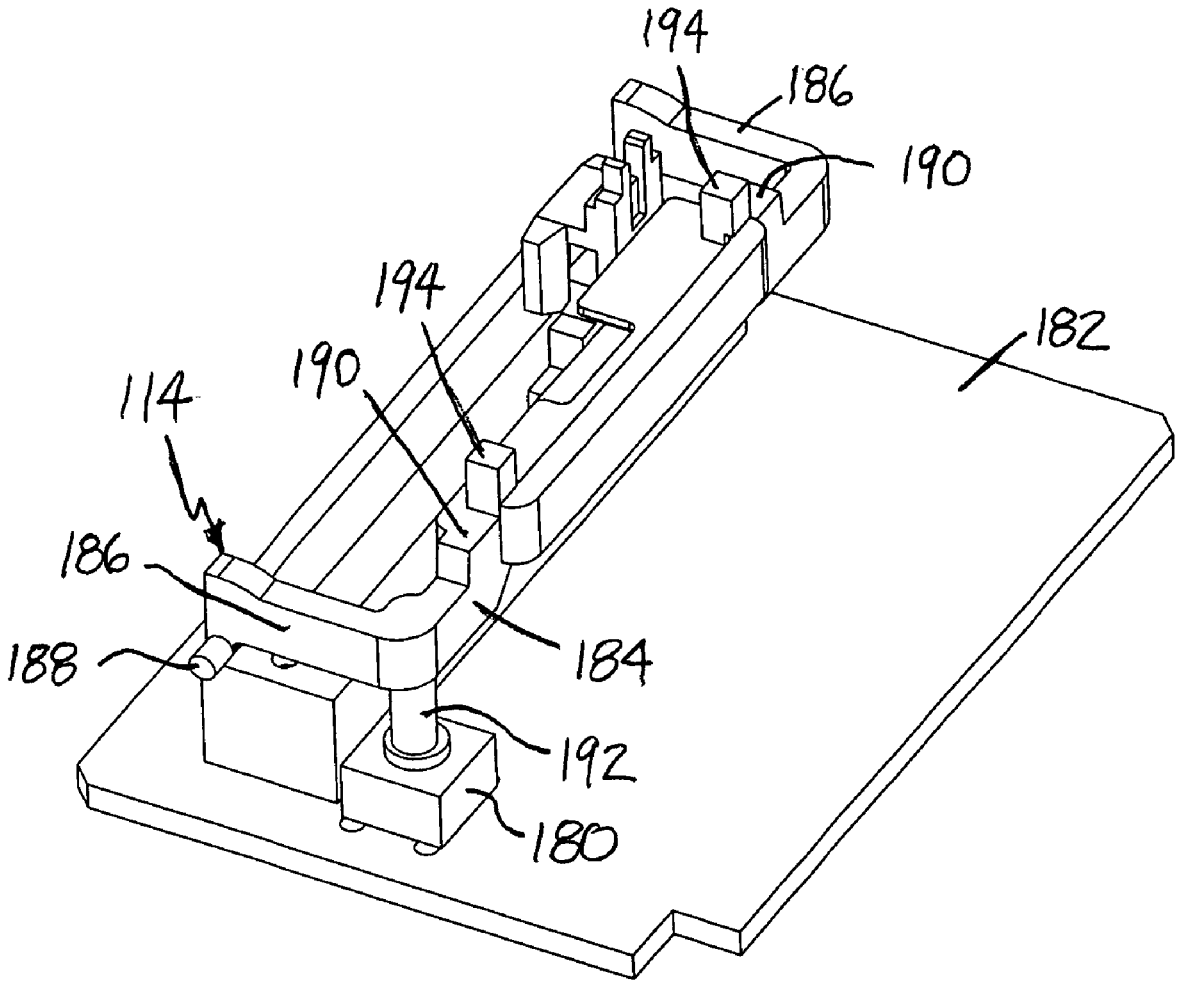
FIG. 9 is a perspective view of a hinge bar and switch of the on/off mechanism of the lighting control of FIG. 1.

Referring to FIG. 9, a portion of the on/off mechanism 102 of lighting control 100, including hinge bar 114, that underlies the button 104 is shown separated from the lighting control 100 to facilitate description. The on/off mechanism 102 includes a switch 180 supported on an upper surface of a board 182 (e.g., a printed circuit board). As shown, the hinge bar 114 is generally C-shaped including a center arm 184 and opposite end arms 186. The hinge bar 114 includes a hinge post 188 adjacent a terminal end of each of the end arms 186. The hinge posts 188 on the end arms 186 are pivotably supported within the interior of the lighting control 100 by upstanding elements (not shown) of the lighting control 100 such that the hinge bar 114 pivots about an axis that extends through the hinge posts 188.

As shown, an intermediate portion of the center arm 184 of hinge bar 114 is tiered to define upper surfaces at locations 190 that are arranged for contact by the posts 152 on the rear surface of button 104. The contact between the posts 152 of button 104 and the locations 190 on hinge bar 114 transfers one of the various actuating motions of button 104, described further below, into a pivoting motion of hinge bar 114 about the hinge posts 188. A contact pin 192 extends from the hinge bar 114 adjacent an intersection between the center arm 184 and one of the end arms 186 to contact the switch 180. As should be understood, this construction locates the switch 180 closer to one of the opposite ends 112 of button 104 than the other. The intermediate action of the pivoting hinge bar 114 allows the switch 180 to be located outside of an underlying footprint boundary on the board 182 defined beneath the button 104 by the perimeter of the button 104.

The hinge bar 114 also includes rectangular posts 194 in the intermediate portion of the center arm 184 adjacent the contact locations 190. Referring again to FIG. 6, the rectangular openings 150 in spring plate 130 that receive the contact posts 152 of button 104 are oversized with respect to the contact posts 152 such that a portion of the opening 150 is not occupied by the post 152. In this manner, space is provided in each opening 150 next to the post 152 to accommodate one of the rectangular posts 194 of the hinge bar 114 for contact with a rear surface of button 104. This provides for alternative contact points between the button 104 and the hinge bar 114 (e.g., either between the button posts 152 and contact locations 190 of hinge bar 114 or between the posts 194 of hinge bar 114 and the rear surface of button 104).

As discussed above, the on/off mechanism 102 is constructed such that the switch 180 is located closer to one end of the button 104 than the other and possibly outside of a boundary defined by the perimeter of the button 104. Notwithstanding such non-centralized location of the switch 180 with respect to button 104, and further notwithstanding the various motions permitted for the button 104, the intermediate action of the hinge bar 114 serves to transfer any button motion into a single, uniform, actuating motion of the switch 180.

Figure 10A:
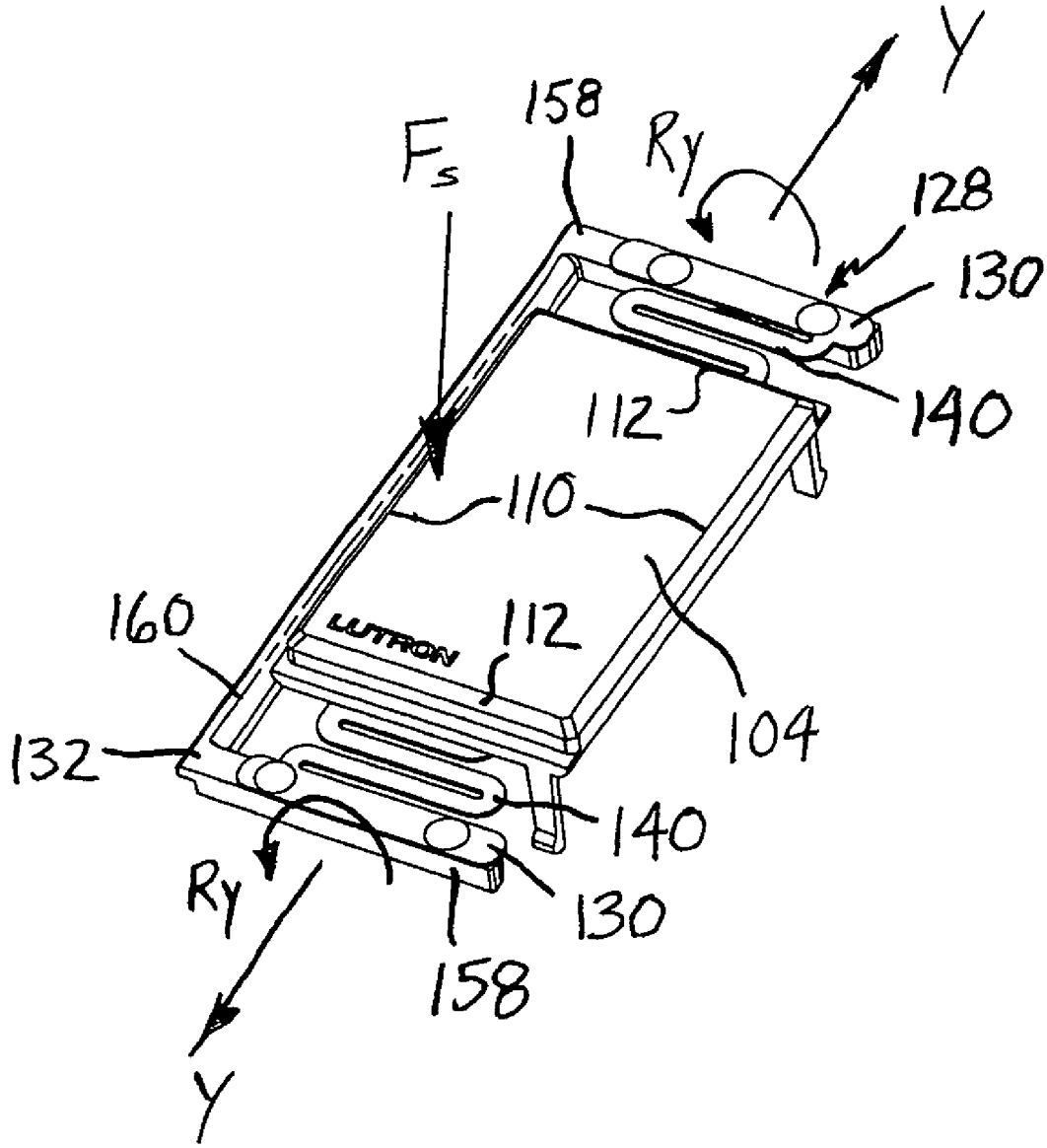
FIGS. 10A through 10C illustrate varying degrees of freedom of movement for the button of the on/off mechanism provided by the mount system of the lighting control of FIG. 3.
Figure 10B:
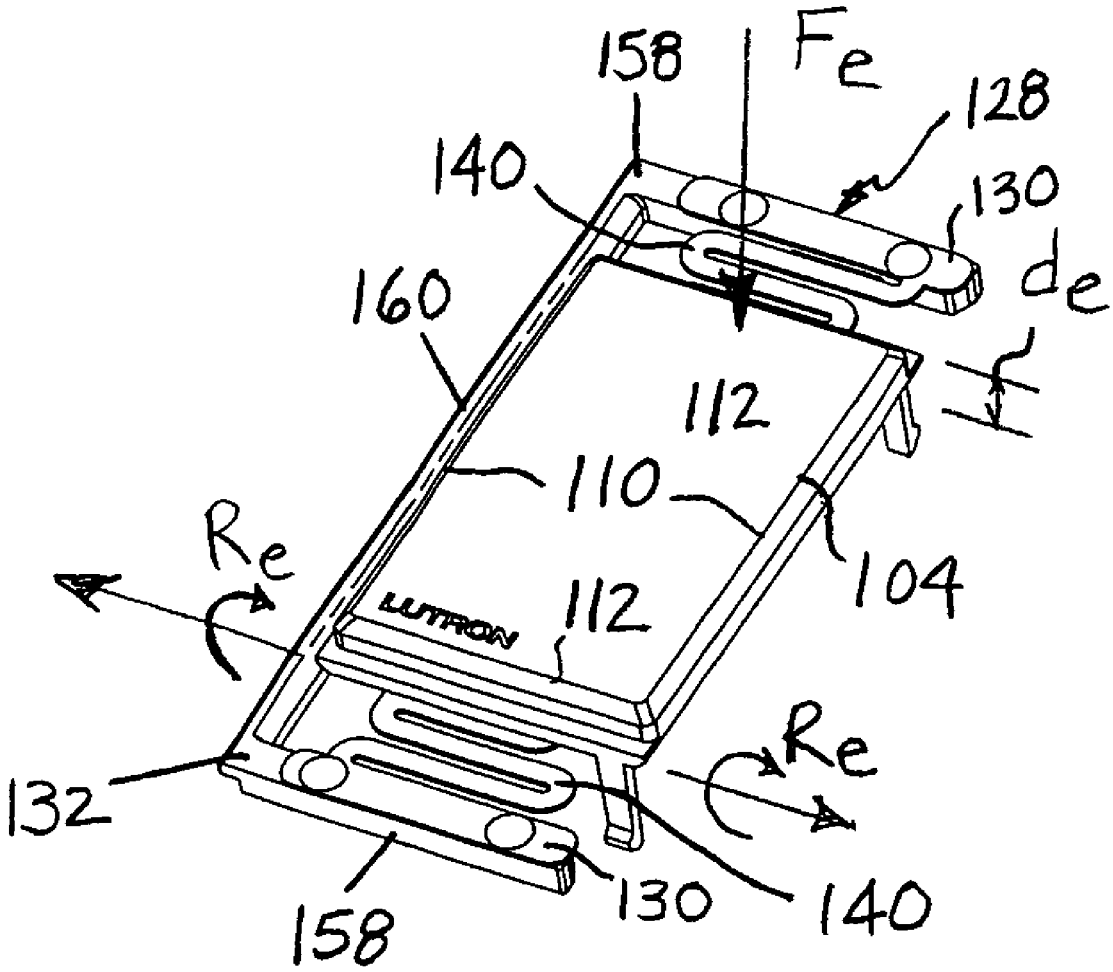
Figure 10C:
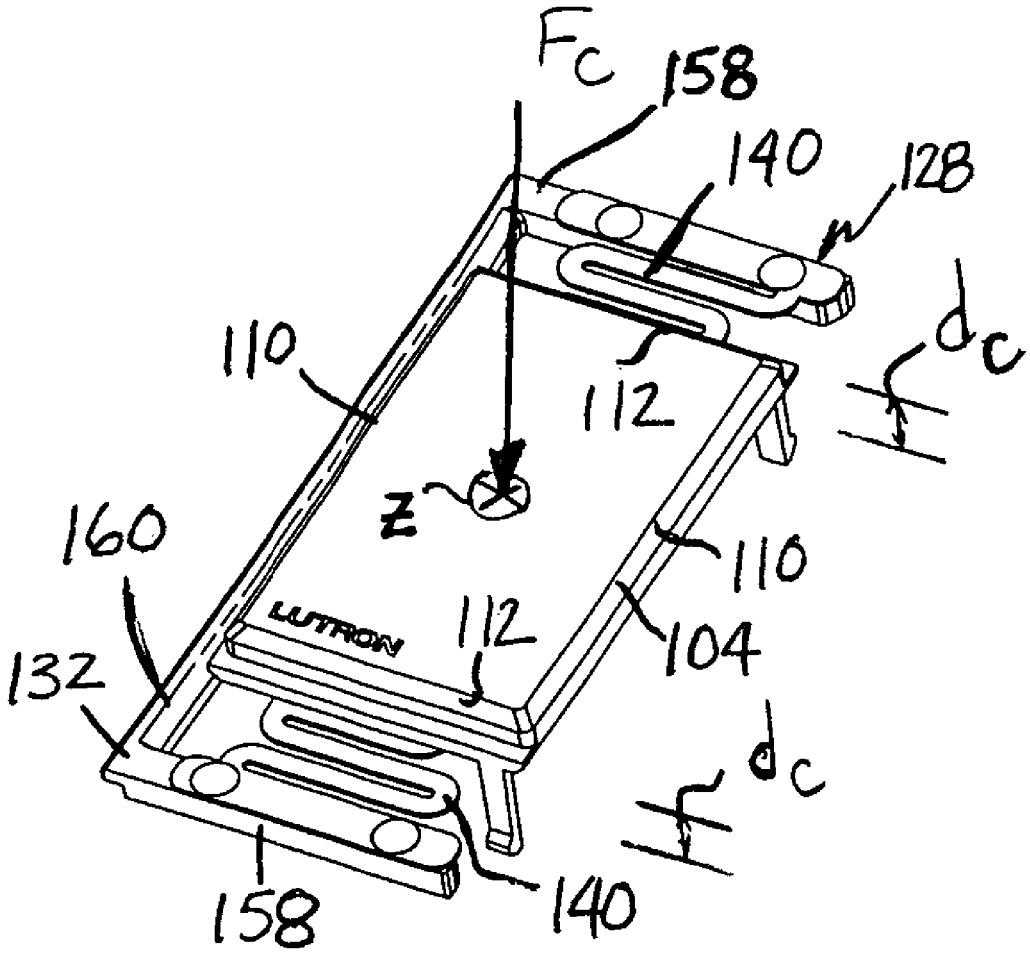

Exemplary actuating motions for button 104 are illustrated in FIGS. 10A through 10C. Referring to FIG. 10A, a user may contact the button 104 adjacent one of the opposite sides 110 of the button 104 to apply an actuating force, shown as $F_s$. As described above, the construction of the serpentine spring elements 140 of spring plate 130 provides for a rotational movement of button 104 about the Y-axis (or longitudinal axis), in a direction represented by $R_y$. The spring plate 130 reacts torsionally to the rotational movement to apply a biasing force tending to return the button 104 to a neutral (i.e., unloaded) position as shown in the figures. As should be understood by one skilled in the art, an application of an actuating force to the opposite side 110 of the button 104 from that shown in FIG. 10A would result in a rotation of button 104 in an opposite direction. As described above, the construction of the spring plate 130 provides for a uniform torsional response of the spring plate 130 regardless of the direction of rotation (i.e., regardless of which side of the button 104 is contacted by a user).

Referring to FIG. 10B, there is shown another exemplary actuating motion for button 104 provided by the assembly 128. A user may contact the button 104 adjacent one of the ends 112 of button 104 to apply an actuating force, $F_e$, to the button 104. As illustrated, the construction of the serpentine spring elements 140 located adjacent both ends of the spring plate 130 results in a deflection (along the Z-axis), shown as $d_e$, of the end 112 of button 104 that is contacted. The opposite end 112 of button 104, which is remotely located from the applied load, will experience only a minimal deflection at most. The resulting motion of the button, therefore, is substantially that of a rotation of the button, shown as $R_e$, about a transverse axis defined by the end 112 of button 104 opposite the end 112 at which the load is applied. As should be understood, a similar load applied to the opposite end 112 of button 104 from that shown (e.g., a load of $F_e$ applied to the near end 112 of button 104 in FIG. 10B) will result in a deflection of $d_e$ at the near end 112 of button 104 and a rotation of $R_e$ about a transverse axis defined by the far end 112 of button 104 in FIG. 10B).

Referring to FIG. 10C, there is shown another exemplary actuating motion of the button 104 provided by the assembly 128. A user may contact the button 104 in a central location (i.e., substantially midway between the opposite sides 110 and substantially midway between the opposite ends 112). The resulting motion of the button 104, as shown, is that of substantially uniform deflection, $d_c$, throughout the button.

Preferably, the button 104 and the support base 132 are both made from a polymer material. Preferably, the polymer material for the button 104 is a thermoplastic material such as polycarbonate. The use of a thermoplastic material, and an associated molding process, facilitates the fabrication of the button 104 and the support base 132 each of which includes numerous formations (e.g., posts, prongs, recesses, etc.). In addition, such materials are desirable for buttons for other reasons such as hardness, scratch-resistance, surface textures, etc.

Preferably, the spring plate 130 is made from a metal such as stainless steel. As should be understood, metals are desirable for flexing spring elements such as spring plate 130 because they possess favorable material properties (e.g., stress/strain characteristics, ductility, etc.). In addition, flexing spring elements of metal tend to retain these desired characteristics even when operating at elevated temperatures. For example, metal has less tendency to creep or become brittle compared to other materials. The use of metal for the spring plate 130 facilitates manufacture because the spring plate 130 may be formed from a plate or sheet of metal (e.g., in a stamping process).

The construction of assembly 128 of the present invention, therefore, having flexing spring elements formed from a different material than the button, provides for optimization of the material properties as well as the fabrication of both the button and the button mounting system.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A system for mounting a button having opposite ends; the mounting system comprising:

a spring plate having first and second spring elements each coupled to the button and located adjacent one of the opposite ends of the button, each of the spring elements having a serpentine portion located at opposite ends of a center portion defined by the spring plate, the spring plate further comprising end portions arranged at opposite ends of the spring plate, such that each of the spring elements is disposed between the center portion of the spring plate and one of the end portions of the spring plate; and a base supported by a surface, each of the spring elements of the spring plate coupled to the base such that the spring elements are supported at a distance from the surface when the base is supported by the surface;

wherein the button includes opposite sides and wherein the base includes a pair of pedestal portions each supporting one of the end portions of the plate, the base further including a side bar extending along one of the sides of the button between the pedestal portions of the base, and wherein the side bar of the base is adapted for receipt within a retainer channel defined by a support member.

2. The mounting system according to claim 1, wherein the serpentine portion of each of the spring elements includes first and second legs extending substantially parallel to each other in side-by-side fashion, the first and second legs connected to each other at one end of the legs.

3. The mounting system according to claim 1, wherein the side bar includes a notch adapted for receiving a wall of the channel.

4. An assembly for a control unit, the assembly comprising:

a button having opposite ends;

first and second spring elements each coupled to the button and located adjacent one of the opposite ends of the button;

a switch; and a hinge bar disposed between the button and the switch and supported for pivot about an axis, the hinge bar arranged to actuate the switch in a uniform actuation motion in response to any one of the actuating motions of the button;

wherein each of the spring elements includes a serpentine portion adapted for multiple degrees of freedom to provide varying actuating motions of the button.

5. The assembly according to claim 4, wherein the serpentine portion of each of the spring elements includes first and second legs extending substantially parallel to each other in side-by-side fashion, the first and second legs connected to each other at one end of the legs.

6. The assembly according to claim 4, wherein each of the spring elements is defined by a plate having a center portion arranged such that the center portion is disposed between the spring elements, the plate further defining opposite end portions defining opposite ends of the plate such that each of the spring elements is disposed between the center portion and one of the end portions.

7. The assembly according to 6, further comprising a base having a pair of pedestal portions each supporting one of the end portions of the plate, the end portions of the plate being secured to the pedestal portions of the base and the button being secured to the center portion of the plate.

8. The assembly according to claim 7, wherein the button defines posts received in openings in the center portion of the plate and wherein the pedestal portions of the base define posts received in openings in the end portions of the plate.

9. The assembly according to claim 7, wherein the button includes opposite sides and wherein the base includes a side bar extending along one of the sides of the button between the pedestal portions of the base, and wherein the side bar of the base is adapted for receipt within a retainer channel defined by a support member of the control unit.

10. The assembly according to claim 9, wherein the button includes a pair of elongated prongs adapted for snap attachment within an interior defined by the control unit.

11. The assembly according to claim 4, wherein the button includes opposite sides and wherein the actuating motions of the button include a substantially uniform displacement of the button resulting from contact of a user near a center of the button, a rotation of the button about a first axis extending through each of the spring elements resulting from contact of a user adjacent one of the sides of the button, and a rotation of the button about a second axis defined by one of the ends of the button resulting from contact of a user adjacent the opposite end of the button.

12. The assembly according to claim 4, wherein each of the spring elements is defined by a plate having a center portion arranged such that the center portion is disposed between the spring elements, the plate further defining opposite end portions defining opposite ends of the plate such that each of the spring elements is disposed between the center portion and one of the end portions.

13. The assembly according to claim 12, further comprising a base including a pair of pedestal portions each supporting one of the end portions of the plate, the base also including a side bar extending between the pedestal portions, the side bar of the base adapted for receipt within a retainer channel defined by the control unit.

14. The assembly according to claim 4, further comprising at least one contact post disposed between a rear surface of the button and a center arm of the hinge bar.

15. The assembly according to claim 14, wherein the at least one contact post is connected to the rear surface of the button and adapted for contact with a surface of the center arm of the hinge bar.

16. The assembly according to claim 15, further comprising at least one post connected to the center arm of the hinge bar and adapted for contact with the rear surface of the button.

17. The assembly according to claim 4, further comprising a contact post connected to the hinge bar and adapted to contact the switch to actuate the switch in response to an actuating motion of the button.

18. An assembly for a control unit having a yoke, the assembly comprising:

a button comprising a polymeric material and defining opposite ends; and a spring plate comprising a metal secured to the button, the spring plate supporting the button at a distance from a front surface of the yoke, the spring plate including first and second spring elements each located adjacent one of the opposite ends of the button and adapted to provide multiple degrees of freedom of movement for the button; and a base having a pair of pedestal portions each supporting the spring plate adjacent an end of the spring plate, each of the pedestal portions including a plurality of posts received by openings defined by the spring plate to secure the spring plate to the base.

19. The assembly according to claim 18, wherein the button comprises a polymeric material.

20. The assembly according to claim 19, wherein the button comprises a thermoplastic material.

21. The assembly according to claim 18, wherein each of the spring elements of the spring plate includes a serpentine portion having first and second legs extending substantially parallel to each other in side-by-side fashion, the first and second legs connected to each other at one end of the legs.

22. The assembly according to claim 18, wherein the spring plate includes a center portion disposed between the spring elements of the spring plate and wherein the button defines a plurality of posts received in openings defined by the plate to secure the button to the plate.

23. An actuator assembly comprising:

a button having opposite ends, the button including a plurality of posts connected to a rear surface of the button;

first and second spring elements coupled to the button and located adjacent the opposite ends of the button, each of the spring elements including first and second legs extending substantially parallel to each other in side-by-side fashion, the legs of each spring element connected to each other at one end of the legs and substantially co-planar with each other when the spring element is in an unloaded neutral condition, the first and second spring elements defined by a metal plate including a center portion disposed between the spring elements, the posts on the rear surface of the button adapted for receipt within openings defined by the center portion of the plate to secure the button to the plate, the plate further including a pair of end portions each defining an end of the plate such that each of the spring elements is disposed between the center portion of the plate and one of the end portions of the plate; and a base having a pair of pedestal portions each supporting one of the end portions of the plate, each of the pedestal portions defining posts received by openings defined by one of the end portions to secure the plate to the base.

24. The actuator assembly according to claim 23, wherein the button is made from a thermoplastic material.

* * * * *